US011198313B2

(12) United States Patent
Ozaki

(10) Patent No.: US 11,198,313 B2
(45) Date of Patent: Dec. 14, 2021

(54) METHOD OF MANUFACTURING PRINTED MATTER, PRINTED MATTER, AND DEVICE FOR MANUFACTURING PRINTED MATTER

(71) Applicant: RICOH COMPANY, LTD., Tokyo (JP)

(72) Inventor: Daisuke Ozaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 16/528,047

(22) Filed: Jul. 31, 2019

(65) Prior Publication Data

US 2020/0039274 A1 Feb. 6, 2020

(30) Foreign Application Priority Data

Jul. 31, 2018 (JP) ..... JP2018-144357
May 22, 2019 (JP) ..... JP2019-095668

(51) Int. Cl.
*B41M 5/50* (2006.01)
*B41J 11/00* (2006.01)

(52) U.S. Cl.
CPC ..... *B41M 5/502* (2013.01); *B41J 11/002* (2013.01)

(58) Field of Classification Search
None
See application file for complete search history.

(56) References Cited

U.S. PATENT DOCUMENTS

2009/0297826 A1 12/2009 Hedman
2014/0093679 A1* 4/2014 Okamoto ..... C09J 133/062 428/106
2015/0077481 A1 3/2015 Yoshino et al.
2017/0009091 A1* 1/2017 Herlihy ..... C08F 2/50
2017/0253680 A1 9/2017 Yamada
2017/0260405 A1 9/2017 Kumai et al.
2017/0327705 A1 11/2017 Yamada
2018/0208783 A1 7/2018 Takahashi et al.
2018/0333909 A1 11/2018 Arita et al.
2019/0023924 A1 1/2019 Yamada
2019/0100667 A1 4/2019 Miyaake et al.
2020/0048411 A1* 2/2020 Zhao ..... C08G 59/686
2020/0377746 A1* 12/2020 Fleckenstein ..... B41J 11/002

FOREIGN PATENT DOCUMENTS

JP 2006-206375 8/2006
JP 2006-307412 11/2006
JP 2015-083656 4/2015
WO WO2006/010853 A1 2/2006

* cited by examiner

*Primary Examiner* — Scott A Richmond
(74) *Attorney, Agent, or Firm* — Grüneberg and Myers PLLC

(57) ABSTRACT

A method of manufacturing printed matter includes applying a curable composition to a water-absorptive substrate, wherein the curable composition has a moisture content ratio of 0.4 percent by mass or less.

17 Claims, 1 Drawing Sheet

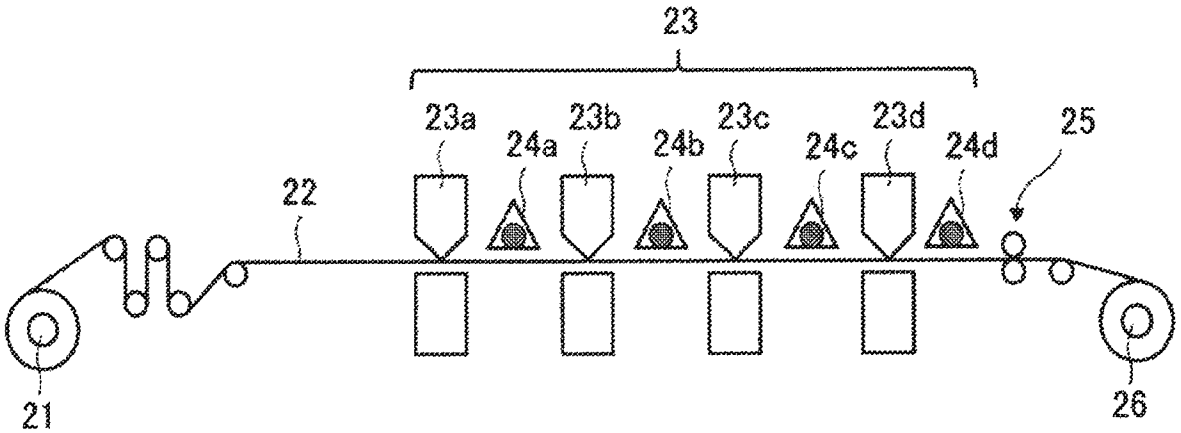
23
23a
24a
23b
24b
23c
24c
23d
24d
22
25
21
26

METHOD OF MANUFACTURING PRINTED MATTER, PRINTED MATTER, AND DEVICE FOR MANUFACTURING PRINTED MATTER

CROSS-REFERENCE TO RELATED APPLICATIONS

This patent application is based on and claims priority pursuant to 35 U.S.C. § 119 to Japanese Patent Application Nos. 2018-144357 and 2019-095668, filed on Jul. 31, 2018 and May 22, 2019, respectively, in the Japan Patent Office, the entire disclosures of which are hereby incorporated by reference herein.

BACKGROUND

Technical Field

The present invention relates to a method of manufacturing printed matter, printed matter, and a device for manufacturing printed matter.

Description of the Related Art

Active energy ray curable inkjet inks as curable compositions do not require a drying process. Therefore, it has a high substrate compatibility and is used to decorate a building material substrate and automobile parts.

For example, printing on a water-absorptive substrate such as a gypsum board with an active energy ray curable ink is expanding.

Of these, the gypsum board involves problems about printing on a water-absorptive substrate, which is peculiar to the gypsum board. That is, the gypsum board is likely to warp such that the expiration date is set after production. A known cause thereof is the influence of moisture.

SUMMARY

According to embodiments of the present disclosure, provided is a method of manufacturing printed matter which includes applying a curable composition to a water-absorptive substrate, wherein the curable composition has a moisture content ratio of 0.4 percent by mass or less.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawing, which is intended to depict example embodiments of the present invention and should not be interpreted to limit the scope thereof. The accompanying drawing is not to be considered as drawn to scale unless explicitly noted.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc., in the present disclosure represent the same meaning, unless otherwise specified.

Embodiments of the present invention are described in detail below with reference to accompanying drawing. In describing embodiments illustrated in the drawing, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to the present disclosure, a method of manufacturing printed matter is provided which is capable of providing printed matter with less warp.

Method of Manufacturing Printed Matter

The method of manufacturing printed matter of the present disclosure includes applying a curable composition onto a water-absorptive substrate and the moisture content of the curable composition is 0.4 percent by mass or less. The method also preferably includes curing the curable composition and other optional processes.

The present inventors made an investigation about the method of manufacturing printed matter with less warp and have found the following knowledge.

For example, inkjet printing is a choice as a method of directly printing on a water-absorptive substrate such as gypsum board. However, when ink containing moisture is used on a water-absorptive substrate such as a gypsum board in typical inkjet printing methods, the water-absorptive substrate warps so that the distance between the surface of the water-absorptive substrate and an inkjet head varies depending on the site of the water-absorptive substrate. This disturbs image forming or causes failure of working.

Therefore, the present inventors have found that due to the setting of the moisture content of a curable composition applied to a water-absorptive substrate easily affected by the presence of water to 0.4 percent by mass or less, printed matter with less warp can be obtained for the water-absorptive substrate.

The moisture content of the curable composition of the present disclosure means the moisture content, etc. at the time of storage of the curable composition after manufacturing or immediately before an application thereof to the water-absorptive substrate.

In addition, to measure the warp, printed matter is placed on a flat surface and load is applied to a side of the printed matter to make it attached to the flat surface, thereby floating the opposite side from the flat surface. This floating (height) from the flat surface is measured as the warp. Note that the flat surface means a surface from 0 to 0.0086 degrees as measured by a level (manufactured by Ebisu Co., Ltd.). In the present specification, printed matter with less warp means that it has a warp of 1 mm or less according to the measuring method described above.

Application Process

A curable composition is applied to a water-absorptive substrate in the application process.

Water-Absorptive Substrate

The water-absorptive substrate has a thickness of 0.5 mm or more and when 0.1 mL of water is dripped onto the surface of the water-absorptive substrate at normal temperature and pressure, the droplets are absorbed into the water-absorptive substrate within one minute of the dripping and disappear from the surface.

The water-absorptive substrate may be made of a material having water-absorptivity or may have a structure having water-absorptivity even though the substrate itself is not water-absorptive.

Examples of the material of the water-absorptive substrate include, but are not limited to, wood, plastic, cardboard, a composite material in which these materials are integrally combined, a water-absorptive inorganic substrate, paper clay, and diatomaceous earth.

Examples of the water-absorptive inorganic substrate include, but are not limited to, metal oxides and pumice. An example of the metal oxide is plaster.

Examples of the cardboard include, but are not limited to, chip balls, coated balls, and cardboards.

An example of the structure of the water-absorptive substrate is a porous structure.

The size of the water-absorptive substrate is not particularly limited and can be suitably selected to suit to a particular application.

The form of the water-absorptive substrate is not particularly limited and can be suitably selected to suit to a particular application. For example, it can take a board-like form, a spherical form, and an irregular form. In addition, the warp of the water-absorptive substrate tends to notably occur when the water-absorptive substrate has a board-like form having a thickness of 10 mm or less.

Specific example of the water-absorptive substrate include, but are not limited to, a gypsum board and a diatomaceous earth board.

Curable Composition

The curable composition is not particularly limited as long as it can be cured by an external stimulus, and can be suitably selected to suit to a particular application. Examples include, but are not limited to, a thermocurable composition curable by heat and optically curable composition curable by light.

The curable composition has a moisture content ratio of 0.4 percent by mass or less, preferably further contains a monomer, and other optional components such as a polymerization initiator, a coloring material, and an organic solvent. The moisture content contained in the curable composition means the moisture content contained in the curable composition itself before the curable composition is attached to the water-absorptive substrate.

The curable composition contains moisture because, for example, water may be originally contained in the raw material, water is mixed into raw material having water-absorptivity over time, water in the air is mixed into the curable composition during stirring, or water is absorbed therein depending on the storage method of an active energy ray curable ink. The moisture content can be controlled by selection of raw materials, adjustment of stirring time, adjustment of the manufacturing environment, implementation of dehydration, and selection of a container.

When the moisture content ratio of the curable composition is 0.4 percent by mass or less, deformation such as warp of the water-absorptive substrate ascribable to the moisture contained in the curable composition can be prevented upon application of the curable composition to the water-absorptive substrate. The moisture content ratio of the curable composition is more preferably 0.2 percent by mass or less.

A measuring method of the moisture content of the curable composition is not particularly limited and can be suitably selected to suit to a particular application. For example, the moisture content can be measured by coulometric titration type Karl Fischer moisture meter (MKA-610, manufactured by KYOTO ELECTRONICS MANUFACTURING CO., LTD.) at room temperature of 25 degrees C. and relative humidity of 40 percent or gas chromatograph (Nexis GC-2030, manufactured by Shimadzu Corporation.

Also, the moisture content of the curable composition can be measured in such a manner that after printing on a PET substrate (E20, Lumirror, thickness of 188 μm) in such printing conditions that the discharging amount of liquid droplets per unit area is 15 $g/m^2$, the printed film is weighed together with the substrate by an electronic balance, the moisture content contained in the curable composition is multiplied by the weight of the film and thereafter the weight of only the non-printing substrate is subtracted.

Monomer

The monomer is not particularly limited as long as it can be cured by heat or polymerization reaction caused by active energy rays (such as ultraviolet rays and electron beams) or active species produced by active energy rays. It can be suitably selected to suit to a particular application. An example is a hydrophilic monomer. In addition, as the monomer, according to the number of functional groups, a monofunctional monomer and a multi-functional monomer are suitable. The monomer may be any polymerizable composition, which may contain a polymerizable oligomer and a polymerizable polymer (macromonomer). These can be used alone or in combination.

Hydrophilic Monomer

The hydrophilic monomer has a functional group demonstrating polarity such as a hydroxyl group, a carboxyl group, and an amino group. The hydrophilic monomer is not particularly limited and can be suitably selected to suit to a particular application.

Specific examples include, but are not limited to, hydroxyethyl(meth)acrylate, hydroxyethyl(meth)acrylamide, (meth)acryloyl morpholine, N-vinyl caprolactam, dimethylaminopropyl(meth)acrylamide, 2-hydroxyethyl(meth) acrylate, 2-hydroxypropyl(meth)acrylate, 2-hydroxybutyl (meth)acrylate, 2-hydroxy-3-phenoxypropyl(meth)acrylate, 2-(meth)acryloyloxyethyl-succinic acid, 2-(meth) acryloyloxyethyl hexahydrophthalic acid, 2-(meth)acryloyloxyethyl-2-hydroxyethyl-phthalic acid, 2-(meth)acryloyloxyethyl hexahydrophthalic acid, and 2-(meth)acryloyloxyethyl acid phosphate. Of these, (meth)acryloyl morpholine is preferable.

The proportion of the hydrophilic monomer in the total mass of curable composition is preferably 30 percent by mass or less and more preferably from 10 to 20 percent by mass. Inclusion of a hydrophilic monomer enhances attachability of the curable composition to the surface of a substrate having a polar group. In addition, when the proportion of the hydrophilic monomer is 30 percent by mass or less, due to moisture absorption by the hydrophilic monomer, it is possible to prevent the moisture content in the curable composition from excessively increasing. By preventing the moisture content in the curable composition from excessively increasing due to the hydrophilic monomer, deformation such as warp of the water-absorptive substrate ascribable to the moisture in the curable composition can be prevented.

Mono-Functional Monomer

The mono-functional monomer has no particular limit and can be suitably selected to suit to a particular application.

Specific examples include, but are not limited to, hydroxyethyl(meth)acrylamide, (meth)acryloyl morpholine, dimethyl aminopropyl(meth)acrylamide, isobornyl(meth) acrylate, adamantyl(meth)acrylate, 2-methyl-2-adamantyl (meth)acrylate, dicyclopentenyl(meth)acrylate, dicyclopentanil(meth)acrylate, dicyclopentenyloxy ethyl(meth) acrylate, 3,3,5-trimethylcyclohexane (meth)acrylate, t-butyl (meth)acrylate, tetrahydrofurfuryl(meth)acrylate, cyclohexyl(meth)acrylate, benzyl(meth)acrylate, 2-hydroxyethyl(meth)acrylate, 2-hydroxypropyl(meth)acrylate, 2-hydroxybutyl(meth)acrylate, isobutyl(meth)acrylate, phenoxyethyl(meth)acrylate, (2-methyl-2-ethyl-1,3-dioxolan-4-yl)methyl(meth)acrylate, and cyclic trimethylol propane formal acrylate. These can be used alone or in combination.

Multi-Functional Monomer

Furthermore, the multi-functional monomer includes a bi-functional monomer, a tri-functional monomer, or a higher functional monomer.

The multi-functional monomer has no particular limit and can be suitably selected to suit to a particular application.

Specific examples include, but are not limited to, neopentyl glycol di(meth)acrylate, (poly)ethylene glycol di(meth) acrylate, diethyl ene glycol di(meth)acrylate, triethylene glycol di(meth)acrylate, tetraethyl ene glycol di(meth)acrylate, polypropylene glycol di(meth)acrylate, dipropylene glycol di(meth)acrylate, tripropylene glycol di(meth)acrylate, (poly)tetramethylene glycol di(meth)acrylate, di(meth) acrylate of an adduct of bisphenly A with propyleneoxide (PO), ethoxyfied neopentyl glycol di(meth)acrylate, propoxynated neopentyl glycol di(meth)acrylate, di(meth) acrylate of an adduct of bisphenol A with ethylene oxide (EO), EO-modified pentaerythritol tri(meth)acrylate, PO-modified pentaerythritol tri(meth)acrylate, EO-modified pentaerythritol tetra(meth)acrylate, PO-modified pentaerythritol tetra(meth)acrylate, EO-modified dipentaerythritol tetra(meth)acrylate, PO-modified dipentaerythritol tetra (meth)acrylate, trimethylol propane tri(meth)acrylate, EO-modified trimethylol propane tri(meth)acrylate, PO-modified trimethylol propane tri(meth)actylate, EO-modified tetramethylol methane tetra(meth)acrylate, PO-modified tetramethylol methane tetra(meth)acrylate, pentaerythritol tetra(meth)acrylate, dipentaerythritol tetra (meth)acrylate, trimethylol propane tri(meth)acrylate, tetramethylol methane tetra(meth)acrylate, trimethylol ethanetri(meth)acrylate, bis(4-(meth)acryloxy polyethoxyphenyl)propane, diallylphthalate, triallyltrimellitate, 1,6-hexane diol di(meth)acrylate, 1,9-nonane diol(meth)acrylate, 1,3-butylene glycol di(meth)acrylate, 1,10-decane diol di(meth) acrylate, hydroxy pivalic acid neopentyl glycol di(meth) acrylate, tetramethylol methane tri(meth)acrylate, dimethylol tricyclodecane di(meth)acrylate, modified glycerine tri(meth)acrylate, an adduct of bisphenol A with diglycidylether (meth)acrylic acid, modified bisphenol A di(meth) acrylate, caprolactone-modified dipentaerythritol hexa (meth)acrylate, dipentaerythritol hexa(meth)acrylate, pentaerythritoltri(meth)acrylate tolylene diisocyanate urethane prepolymer, pentaerythritoltri(meth)acrylate hexamethylene diisocyanate urethane prepolymer, urethaneacrylate oligomer, epoxyacrylate oligomer, polyesteracrylate oligomer, polyetheracrylate oligomer, and silicone acrylate oligomer. These can be used alone or in combination.

Polymerization Initiator

The curable composition may contain a polymerization initiator. Examples include, but are not limited to, polymerization initiators that initiates polymerization by external stimuli such as heat and light. Of these, when light is used, the polymerization initiator produces active species such as a radical or a cation upon an application of, for example, energy of active energy rays and initiates polymerization of a polymerizable compound (monomer or oligomer). As the polymerization initiator, it is suitable to use a known radical polymerization initiator, a cation polymerization initiator, a base producing agent, or a combination thereof. Of these, radical polymerization initiators are preferable. Moreover, the polymerization initiator preferably accounts for 5 to 20 percent by mass of the total content (100 percent by mass) of the composition to obtain a sufficient curing speed.

Specific examples of the radical polymerization initiators include, but are not limited to, aromatic ketones, acylphosphineoxide compounds, aromatic oniumchlorides, organic peroxides, thio compounds (thioxanthone compounds, compounds including thiophenyl groups, etc.), hexaarylbiimidazole compounds, ketoxime-esterified compounds, borate compounds, azinium compounds, metallocene compounds, active ester compounds, compounds having a carbon halogen bond, and alkylamine compounds.

In addition, a polymerization accelerator (sensitizer) can be optionally used together with the polymerization initiator. The polymerization accelerator is not particularly limited. Preferred examples thereof include, but are not limited to, amine compounds such as trimethylamine, methyldimethanolamine, triethanolamine, p-diethylaminoacetophenone, p-dimethyl aminoethylbenzoate, p-dimethyl aminobenzoate-2-ethylhexyl, N,N-dimthylbenzylamine, and 4,4'-bis(diethylamino)benzophenone. The content can be suitably determined to suit to the identification and the content of the polymerization initiator used in combination with the polymerization accelerator.

Coloring Material

The curable composition of the present disclosure may contain a coloring agent. As the coloring agent, depending on the objectives and requisites of the composition in the present disclosure, various pigments and dyes can be used, which impart black, white, magenta, cyan, yellow, green, orange, and gloss color such as gold and silver. The proportion of the coloring agent in the curable composition is not particularly limited but determined considering the desired color density and dispersibility of the coloring agent in the curable composition, etc. It is preferred that the proportion of the coloring agent account for 0.1 to 20 percent by mass of the total content (100 percent by mass) of the composition. The curable composition does not necessarily include a coloring material but can be clear and colorless. If the curable composition contains no coloring material, the composition is suitable as an overcoat layer to protect images.

As the pigment, an inorganic or organic pigment can be used alone or in combination.

Specific examples of the inorganic pigment include, but are not limited to, carbon blacks (C.I. Pigment Black 7) such as furnace black, lamp black, acetylene black, and channel black, iron oxides, and titanium oxides.

Specific examples of the organic pigment include, but are not limited to, azo pigments such as insoluble azo pigments, condensed azo pigments, azo lakes, and chelate azo pigments, polycyclic pigments such as phthalocyanine pigments, perylene pigments, perinone pigments, anthraquinone pigments, quinacridone pigments, dioxane pigments, thioindigo pigments, isoindolinone pigments, and quinophthalone pigments, dye chelate such as basic dye type chelate and acid dye type chelate, dye lakes such as basic dye type lake and acidic dye type lake, nitro pigments, nitroso pigments, aniline black, and daylight fluorescent pigments.

In addition, a dispersant is optionally added to enhance dispersibility of a pigment. The dispersant has no particular limit. For example, it is suitable to use a polymer dispersant conventionally used to prepare a pigment dispersion.

The dye includes, for example, an acidic dye, a direct dye, a reactive dye, a basic dye, and a combination thereof.

Organic Solvent

The curable composition may contain an organic solvent, but if possible, it is preferred that the composition be free of an organic solvent. The composition free of an organic solvent, in particular a volatile organic compound (VOC), is preferable because it enhances safeness at where the composition is handled so that pollution of the environment can be prevented. The organic solvent represents a conventional non-reactive organic solvent, for example, ether, ketone, xylene, ethylacetate, cyclohexanone, and toluene, which is clearly distinguished from reactive monomers. Furthermore, "free of" an organic solvent means that no organic solvent is substantially included. The proportion thereof is preferably less than 0.1 percent by mass.

Other Components

The curable composition may furthermore optionally include other known components. The other known components are not particularly limited. Examples are known articles such as surfactants, polymerization inhibitors, leveling agents, defoaming agents, fluorescent brighteners, penetration-enhancing agents, wetting agents (humectants), fixing agents, viscosity stabilizers, fungicide, preservatives, antioxidants, ultraviolet absorbents, chelate agents, pH regulators, and thickeners.

Preparation of Curable Composition

The curable composition can be prepared by using the components mentioned above. The preparation devices and conditions are not particularly limited.

For example, the curable composition can be prepared by loading a polymerizable monomer, a pigment, a dispersant, etc., into a dispersing machine such as a ball mill, a kitty mill, a disk mill, a pin mill, and a DYNO-MILL to prepare a pigment liquid dispersion followed by mixing with a polymerizable monomer, an initiator, a polymerization inhibitor, and a surfactant.

However, in the preparation of the curable composition, water absorption is caused by the hydrophilic polymer contained therein, and the temperature at the time of preparation is from 20 to 28 degrees C. and the relative humidity is preferably from 30 to 50 percent. Moreover, the stirring time is preferably 2 hours or less.

Viscosity

Viscosity of the composition has no particular limit and it can be adjusted to suit to a particular application and device. For example, if a discharging device that discharges the curable composition from nozzles is used, the viscosity thereof is preferably in the range of from 3 to 40 mPa·s, more preferably from 5 to 15 mPa·s, and particularly preferably from 6 to 12 mPa·s in the temperature range of from 20 to 65 degrees C. and preferably at 25 degrees C. In addition, it is particularly preferable to satisfy this viscosity range without containing the organic solvent mentioned above. The viscosity can be measured by a cone-and-plate type rotary viscometer (VISCOMETER TVE-22L, manufactured by TOKI SANGYO CO., LTD.) using a cone rotor (1° 34'×R24) at a rotational frequency of 50 rpm at a temperature of hemathermal circulating water in the range of from 20 to 65 degrees C. VISCOMATE VM-150III can be used for the temperature control of the circulating water.

Curing

In the curing process, the curable composition applied onto the water-absorptive substrate is cured by a curing device.

The curing device is not particularly limited and can be suitably selected to suit to a particular application. Examples are curing by heat or curing by active energy rays. Of these, active energy rays are preferable.

The active energy rays for use in curing the curable composition are not particularly limited as long as they can apply energy to conduct polymerization reaction of the polymerizable components in the curable composition. Specific examples include, but are not limited to, electron beams, a rays, 13 rays, y rays, and X rays, in addition to ultraviolet rays. A particularly high energy light source obviates the need for a polymerization initiator to proceed polymerization reaction. In addition, in the case of irradiation of ultraviolet rays, mercury-free is strongly demanded in terms of protection of environment. Therefore, replacement with GaN-based ultraviolet light-emitting devices is greatly preferred from industrial and environmental point of view. Furthermore, ultraviolet ray light-emitting diode (UV-LED) and ultraviolet ray laser diode (UV-LD) are preferable.

Small size, long working life, high efficiency, and high cost performance thereof make such irradiation sources desirable as an ultraviolet light source.

In another embodiment, the method of manufacturing printed matter of the present disclosure includes applying a curable composition to a building material substrate and curing the curable composition to obtain cured matter, wherein the cured matter has a moisture content of 0.06 $g/m^2$ or less.

When the moisture content of the cured matter is 0.06 $g/m^2$ or less, the moisture in the cured matter penetrates, for example, a water-absorptive building material substrate, which prevents deformation such as warp. The time from the application of a curable composition to a water-absorptive building materials until the curing upon application of active energy rays is, for example, preferably within one minute and more preferably within 5 seconds. If the time from the application of a curable composition to a water-absorptive building material to the curing upon application of active energy rays is within one minute, it is possible to reduce absorption of moisture in the air by an uncured curable composition over time.

Note that the water-absorptive substrate mentioned above can used as the building material.

Device for Manufacturing Printer Matter

The device for manufacturing printed matter of the present disclosure includes a curing device to cure the curable composition for use in the method of manufacturing printed matter of the present disclosure and other optional devices.

As the curing device, the same device as those described in the method of manufacturing printed matter of the present disclosure can be used, and therefore the description thereof will be omitted.

The method of manufacturing printed matter and the device for manufacturing printed matter of the present disclosure will be described in more detail. Cured matter forming on a water-absorptive substrate is also referred to as image and manufacturing is also referred to as forming below.

Method of Forming Image and Device for Forming Image

The method of forming an image (e.g., inkjet recording method) may utilize active energy rays, heating, etc.

The method of forming an image includes irradiating a curable composition with an active energy ray to cure the curable composition. The device for manufacturing an image (image forming device) includes an irradiator to irradiate the curable composition with an active energy ray and an accommodating unit to accommodate the curable composition. The accommodating unit may include a container. Furthermore, the method and the device may respectively include a discharging step and a discharging device to discharge the curable composition. The method of discharging the curable composition is not particularly limited. Examples are a continuous spraying method and an on-demand method. The on-demand method includes a piezo method, a thermal method, an electrostatic method, etc.

The accompanying drawing is a diagram illustrating an image forming device including an inkjet discharging device. Printing units 23 (23*a*, 23*b*, 23*c*, and 23*d*) respectively having ink cartridges and discharging heads for yellow, magenta, cyan, and black active energy ray curable inks discharge the inks onto a recording medium 22. Thereafter, light sources 24*a*, 24*b*, 24*c*, and 24*d* emit active energy rays to the inks to cure the inks so that a color image is formed. As the inkjet discharging device and the curing device, there is a multi-pass process in which landing and curing are repeated by separate scanning, or a single-pass process in batch scanning. In any case, there is no difference in the total discharging amount to the substrate. Thereafter, the recording medium 22 is conveyed to a processing unit 25. Each of the printing unit 23*a*, 23*b*, 23*c*, and 23*d* may include a heating mechanism to liquidize the ink at the ink discharging portion. Moreover, a mechanism may be optionally disposed which cools down the recording medium to an ambient temperature in a contact or non-contact manner. In addition, the inkjet recording method may be either of a serial method of discharging an ink onto a recording medium by moving the head while the recording medium intermittently moves in accordance with the width of a discharging head or a line method of discharging an ink onto a recording medium from a discharging head held at a fixed position while continuously moving the recording medium.

The recording medium 22 includes a water-absorptive inorganic substrate such as metal oxides, and water-absorptive substrate such as wood and plastics. The image forming device may have a simplex printing configuration capable of printing on one side of a recording medium or a duplex printing configuration capable of printing on both sides thereof.

Optionally, multiple colors can be printed with no or faint active energy rays from the light sources 24*a*, 24*b*, and 24*c*, followed by irradiation of the active energy rays by the light source 24*d*. This saves energy and cost.

The recorded matter having images printed with the ink includes articles having printed images or texts on a plain surface, articles having printed images or texts on a rough surface, and articles having printed image or texts on a surface made of various materials such as metal oxide or ceramic. In addition, by laminating layers of two-dimensional images in part of a recording medium, a partially stereoscopic image (formed of two dimensional part and three-dimensional part) or a three dimensional object can be fabricated.

Printed Matter

The printed matter of the present disclosure is manufactured by the method of manufacturing printed matter of the present disclosure.

Regarding the water-absorptive substrate and the hydrophilic monomer, the description is omitted because the same method as the method of manufacturing printed matter of the present disclosure can be used.

In addition, the printed matter of the present disclosure contains cured matter of a curable composition on the surface of the water-absorptive substrate in an amount of 15 $g/m^2$ or more and the water-absorptive substrate has a warp of 1 mm or less.

In addition, to measure the warp, printed matter is placed on a flat surface, a load is applied to a side of the printed matter to make it attached to the flat surface, and the floating (height) of the opposite side from the flat surface is measured. Note that the flat surface means a surface from 0 to 0.0086 degrees as measured by a level (manufactured by Ebisu Co., Ltd.).

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto. In Examples, active energy ray curable inks were used as the curable composition.

Preparation Example of Pigment Liquid Dispersion 1.0 part of carboxylic acid ester-containing acrylic block copolymer (dispersant, DISPERBYK-168, acid value of 0 mg KOH/g, amine value of 11 mgKOH/g, manufactured by Byc Chemie Japan Co., Ltd.), 40.0 parts of monofunctional monomer ACMO (acryloyl morpholine represented by the following Chemical formula 1, M-4, manufactured by KJ Chemicals Corporation), and 10.0 parts of carbon black (MA14, manufactured by Mitsubishi Chemical Corporation) were added and mixed by stirring with a stirrer for one hour. Thereafter, the mixture was stirred for two hours by a bead mill to obtain a Bk pigment liquid dispersion.

Chemical formula 1

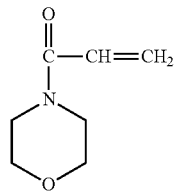

Preparation Examples 1 to 14

Preparation of Active Energy Ray Curable Ink 1 to 14

The ink compositions shown in Tables 1 and 2 were mixed and stirred at 25 degrees C. and a relative humidity of 40 percent for the length of time period shown in Tables 3 to 6 to prepare active energy ray curable inks 1 to 14. The moisture content of the active energy ray curable ink was adjusted based on the amount of hydrophilic monomer shown in Table 1 and Table 2 and the stirring time shown in Table 3 to Table 6.

TABLE 1

| Composition | | | Ink 1 | 2 | 3 | 4 | 5 | 6 | 7 |
|---|---|---|---|---|---|---|---|---|---|
| Hydrophilic monomer | | ACMO | 15 | — | 7.5 | 15 | 15 | 30 | — |
| | | HEAA | — | 15 | 7.5 | 15 | 7.5 | — | 30 |
| | | HOA-HH | — | — | — | — | 7.5 | — | — |
| Non-hydrophilic monomer | Mono-functional monomer | IBXA | 63 | 63 | 63 | 48 | 48 | 48 | 48 |
| | Multi-functional monomer | A200 | 10 | 10 | 10 | 10 | 10 | 10 | 10 |
| Bk pigment liquid dispersion | | | 6 | 6 | 6 | 6 | 6 | 6 | 6 |
| Polymerization initiator | | Ir TPO | 6 | 6 | 6 | 6 | 6 | 6 | 6 |
| Total | | | 100 | 100 | 100 | 100 | 100 | 100 | 100 |
| Amount of hydrophilic monomer (percent by mass) | | | 15 | 15 | 15 | 30 | 30 | 30 | 30 |

TABLE 2

| Composition | | | Ink 8 | 9 | 10 | 11 | 12 | 13 | 14 |
|---|---|---|---|---|---|---|---|---|---|
| Hydrophilic monomer | | ACMO | 30 | 45 | — | 15 | — | — | — |
| | | HEAA | 15 | — | 45 | 15 | — | — | — |
| | | HOA-HH | — | — | — | 15 | — | — | — |
| | | NVC | — | — | — | — | — | 15 | 30 |
| Non-hydrophilic monomer | Mono-functional monomer | IBXA | 33 | 33 | 33 | 33 | 78 | 63 | 48 |
| | Multi-functional monomer | A200 | 10 | 10 | 10 | 10 | 10 | 10 | 10 |
| Bk pigment liquid dispersion | | | 6 | 6 | 6 | 6 | 6 | 6 | 6 |
| Polymerization initiator | | Ir TPO | 6 | 6 | 6 | 6 | 6 | 6 | 6 |
| Total | | | 100 | 100 | 100 | 100 | 100 | 100 | 100 |
| Amount of hydrophilic monomer (percent by mass) | | | 45 | 45 | 45 | 45 | 0 | 15 | 30 |

In Tables 1 and 2, the product and the manufacturing companies of the ingredients are as follows:

Hydrophilic Monomer

Acryloyl morpholine (ACMO): manufactured by KJ Chemicals Corporation

Hydroxyethyl acrylate (HEAA) (manufactured by KJ Chemicals Corporation)

2-acryloyloxyethyl hexahydro phthalic acid (HOA-HH (N)): manufactured by Kyoeisha Chemical Co., Ltd.

N-Vinylcaprolactam (NVC): manufactured by Tokyo Chemical Industry Co., Ltd.

Mono-Functional Monomer

Isoboronyl acrylate (IBXA): manufactured by OSAKA ORGANIC CHEMICAL INDUSTRY LTD.

Multi-Functional Monomer

Polyethylene glycol #200 diacrylate (A-200): manufactured by Shin-Nakamura Chemical Co., Ltd.

Polymerization Initiator 2,4,6-trimethylbenzoyl-diphenyl-phosphine oxide: Ir TPO, manufactured by Lamberti S.p.A.

Example 1

The active energy ray curable ink 1 of Preparation Example 1 was discharged to print a mono-color solid image at 300×600 dpi with the ultraviolet illuminance specified below to obtain Printed matter 1 by an inkjet discharging device carrying MH5421 head (manufactured by Ricoh Co. Ltd.) in a discharging amount of liquid droplets per unit area of 15 g/m$^2$ at a printing speed of 840 mm/s. The ultraviolet light source carried Fireflys on the left and right of the head and conducted a series of operations of printing and UV irradiation. The illuminance during printing was 3 W/cm$^2$. The illuminance (W/cm$^2$) and light intensity (mJ/cm$^2$) were measured in the UVA range of UV Power Puck™ 11 (manufactured by EIT Instrumentation Equipments). The substrate was a gypsum board (Gypster, manufactured by Chiyoda Ute Co., Ltd., thickness of 9.5 mm, size of 910 mm×910 mm).

Examples 2 to 12 and Comparative Examples 1 to 9

Printed matters 2 to 21 were obtained in the same manner as in Example 1 except that Active energy ray curable ink 1 and the stirring time of the ink were changed as shown in Tables 3 to 6.

Next, the moisture content ratio (percent by mass) and the moisture content of cured matter ($g/m^2$) of the active energy ray curable inks 1 to 14 obtained in Examples 1 to 12 and Comparative Examples 1 to 9 and warp of Printed matters of 1 to 21 were measured and evaluated in the following manner. The results are shown in Tables 3 to 6.

Moisture Ratio

The moisture ratio of the thus-obtained active energy ray curable inks 1 to 14 was measured by a coulometric titration Karl Fischer moisture meter (MKA-610, manufactured by KYOTO ELECTRONICS MANUFACTURING CO., LTD.) at a room temperature of 25 degrees C. and a relative humidity of 40 percent one hour before the application to the substrate. After dehydration of a solvent of Medium K (manufactured by Sigma-Aldrich Co. LLC.) with a titration solution of Composite 2 (manufactured by Sigma-Aldrich Co. LLC.), a sample was added to the solvent to measure the moisture content of the sample.

Moisture Content of Cured Matter

After printing on a PET substrate (Lumirror, E20 mirror, thickness of 188 μm, size: 100 mm×100 mm, manufactured by Toray ADVANCED FILM CO., LTD.) on the printing conditions described in Example 1, the mass of the printed cured matter was weighed together with the PET substrate at room temperature of 25 degrees C. and relative humidity of 40 percent by an electronic balance. The mass of the PET substrate was subtracted from the mass of the printed matter on the PET substrate. The obtained mass was multiplied with the moisture content (moisture content ratio) of the measured active energy ray curable ink to obtain the moisture content of the cured matter.

Warp

After printing on a gypsum board (Gypster, thickness of 9.5 mm, size of 910 mm 910 mm, manufactured by Chiyo Daute Co., Ltd.) on the printing conditions described in Example 1, when each of the obtained printed products 1 to 21 were placed on a flat surface and brought into contact with the surface to which load was applied on one side of the printed matter, floating (warping) from the flat surface on the opposing side was measured and evaluated according to the following evaluation criteria.

Evaluation Criteria

A: Warp was 0.5 mm or less

B: Warp was from more than 0.5 to 1 mm

C: Warp was more than 1 mm

TABLE 3

| | | Example | | | | | |
|---|---|---|---|---|---|---|---|
| | | 1 | 2 | 3 | 4 | 5 | 6 |
| Ink | | 1 | 1 | 2 | 2 | 3 | 3 |
| Stirring time (hours) | | 2 | 24 | 2 | 24 | 2 | 24 |
| Evaluation result | Moisture content ratio (percent by mass) of curable composition | 0.18 | 0.21 | 0.16 | 0.20 | 0.17 | 0.20 |

TABLE 3-continued

| | | Example | | | | | |
|---|---|---|---|---|---|---|---|
| | | 1 | 2 | 3 | 4 | 5 | 6 |
| | Moisture content in cured product ($g/m^2$) | 0.029 | 0.032 | 0.024 | 0.031 | 0.027 | 0.033 |
| | Warp | A | B | A | A | A | A |

TABLE 4

| | | Example | | | | | |
|---|---|---|---|---|---|---|---|
| | | 7 | 8 | 9 | 10 | 11 | 12 |
| | Ink | 4 | 5 | 6 | 7 | 12 | 13 |
| | Stirring time (hours) | 2 | 2 | 2 | 2 | 2 | 2 |
| Evaluation result | Moisture content ratio (percent by mass) of curable composition | 0.36 | 0.39 | 0.40 | 0.35 | 0.08 | 0.20 |
| | Moisture content ($g/m^2$) in cured product | 0.058 | 0.060 | 0.060 | 0.052 | 0.013 | 0.030 |
| | Warp | B | B | B | B | A | A |

TABLE 5

| | | Comparative Example | | | |
|---|---|---|---|---|---|
| | | 1 | 2 | 3 | 4 |
| Ink | | 4 | 5 | 6 | 7 |
| Stirring time (hours) | | 24 | 24 | 24 | 24 |
| Evaluation result | Moisture content ratio (percent by mass) of curable composition | 0.54 | 0.57 | 0.60 | 0.52 |
| | Moisture content ($g/m^2$) in cured product | 0.085 | 0.088 | 0.092 | 0.080 |
| | Warp | C | C | C | C |

TABLE 6

| | | Comparative Example | | | | |
|---|---|---|---|---|---|---|
| | | 5 | 6 | 7 | 8 | 9 |
| | Ink | 8 | 9 | 10 | 11 | 14 |
| | Stirring time (hours) | 2 | 2 | 2 | 2 | 24 |
| Evaluation result | Moisture content ratio (percent by mass) of curable composition | 0.66 | 0.70 | 0.60 | 0.68 | 0.62 |
| | Moisture content ($g/m^2$) in cured product | 0.100 | 0.110 | 0.090 | 0.106 | 0.088 |
| | Warp | C | C | C | C | C |

Aspects of the present disclosure are, for example, as follows.

1. A method of manufacturing printed matter includes applying a curable composition to a water-absorptive substrate, wherein the curable composition has a moisture content ratio of from 0.4 percent by mass or less.

2. The method according to 1 mentioned above further includes curing the curable composition with a curing device.

3. The method according to 2 mentioned above, wherein the curing device is configured to cure the curable composition with active energy rays.

4. The method according to any one of 1 to 3 mentioned above, wherein the curable composition has a moisture content ratio of 0.2 percent by mass or less.

5. The method according to any one of 1 to 4 mentioned above, wherein the curable composition contains a hydrophilic monomer in an amount of 30 percent by mass or less.

6. The method according to any one of 1 to 5 mentioned above, wherein the curable composition contains a hydrophilic monomer in an amount of from 10 to 20 percent by mass.

7. The method according to 5 or 6 mentioned above, wherein the hydrophilic monomer contains at least one of a hydroxyl group, an amino group, and a carboxyl group.

8. The method according to any one of 5 to 7 mentioned above, wherein the hydrophilic monomer contains at least one of an acryloyl morpholine, hydroxyethyl acrylate, and 2-acryloyloxyethyl hexahydro phthalic acid.

9. The method according to any one of 1 to 8 mentioned above, wherein the water-absorptive substrate includes a water-absorptive inorganic substrate.

10. The method according to 9 mentioned above, wherein the water-absorptive inorganic substrate includes a gypsum board.

11. The method according to any one of 1 to 10 mentioned above, wherein the curable composition is applied by an inkjet printing method.

12. A method of manufacturing printed matter includes applying a curable composition to a building material substrate and curing the curable composition to obtain cured matter, wherein the cured matter has a moisture content of 0.06 g/m$^2$ or less.

13. Printed matter produced by the method of manufacturing printed matter of any one of 1 to 12 mentioned above.

14. Printed matter contains a water-absorptive substrate and cured matter of a curable composition on the surface of the water-absorptive substrate in an amount of 15 g/m$^2$ or more, wherein the water-absorptive substrate has a warp of 1 mm or less.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A method of manufacturing printed matter, comprising:

applying a curable composition to a water-absorptive substrate, wherein the curable composition has a moisture content ratio of 0.4 percent by mass or less; and wherein a total amount of hydrophilic monomer in the curable composition is from 10 percent by mass to 30 percent by mass.

2. The method according to claim 1, further comprising curing the curable composition with a curing device.

3. The method according to claim 1, wherein the curable composition has a moisture content ratio of 0.2 percent by mass or less.

4. The method according to claim 1, wherein the total amount of the hydrophilic monomer in the curable composition is from 10 to 20 percent by mass.

5. The method according to claim 1, wherein the hydrophilic monomer contains at least one of a hydroxyl group, an amino group, and a carboxyl group.

6. The method according to claim 1, wherein the hydrophilic monomer comprises at least one of an acryloylmorpholine, hydroxyethyl acrylate, and 2-acryloyloxyethyl hexahydro phthalic acid.

7. The method according to claim 1, wherein the water-absorptive substrate comprises a water-absorptive inorganic substrate.

8. The method according to claim 7, wherein the water-absorptive inorganic substrate comprises a gypsum board.

9. The method according to claim 1, wherein the curable composition is applied by an inkjet printing method.

10. The method according to claim 1, further comprising:

curing the curable composition to obtain cured matter, wherein the water-absorptive substrate is a building material substrate, and wherein the cured matter has a moisture content of 0.06 g/m$^2$ or less.

11. Printed matter produced by the method of manufacturing printed matter of claim 1.

12. The printed matter according to claim 11, comprising:

the water-absorptive substrate; and cured matter of the curable composition on a surface of the water-absorptive substrate in an amount of 15 g/m$^2$ or more, wherein the water-absorptive substrate has a warp of 1 mm or less.

13. A method of manufacturing printed matter, comprising:

applying a curable composition to a water-absorptive substrate that comprises an inorganic substrate, wherein the curable composition has a moisture content ratio of 0.4 percent by mass or less;

a total amount of hydrophilic monomer in the curable composition is from 10%-20% by mass; and the hydrophilic monomer comprises at least one of an acryloylmorpholine, hydroxyethyl acrylate, and 2-acryloyloxyethyl hexahydro phthalic acid.

14. A method of manufacturing printed matter, comprising:

applying a curable composition to a water-absorptive substrate, wherein the curable composition has a moisture content ratio of 0.4 percent by mass or less;

wherein the curable composition comprises at least one hydrophilic monomer selected from the group consisting of an acryloylmorpholine, hydroxyethyl acrylate, and 2-acryloyloxyethyl hexahydro phthalic acid, in a total amount of greater than 0 percent by mass and up to 30 percent by mass in the curable composition.

15. The method according to claim 14, wherein the at least one hydrophilic monomer comprises acryloylmorpholine.

16. The method according to claim 14, wherein the at least one hydrophilic monomer comprises hydroxyethyl acrylate.

17. The method according to claim 14, wherein the at least one hydrophilic monomer comprises 2-acryloyloxyethyl hexahydro phthalic acid.

* * * * *